US005680723A

United States Patent [19]

Ruiz

[11] Patent Number: 5,680,723

[45] Date of Patent: Oct. 28, 1997

[54] GUN LOCKING MECHANISM

[76] Inventor: Michael Ruiz, P.O. Box 9193, Elizabeth, N.J. 07208

[21] Appl. No.: 754,535

[22] Filed: Nov. 21, 1996

[51] Int. Cl.[6] ..... F41A 17/54; F41A 17/02

[52] U.S. Cl. ..... 42/70.11; 42/70.07; 70/45; 70/160

[58] Field of Search ..... 42/70.11, 70.07, 42/70.02, 96; 70/41, 45, 46, 159, 160, 162

[56] References Cited

U.S. PATENT DOCUMENTS

| | | | |
|---|---|---|---|
| 2,997,802 | 8/1961 | Robbins | 42/70.11 |
| 3,307,755 | 3/1967 | Lentz | 42/70.11 |
| 3,368,297 | 2/1968 | Lentz | 42/70.07 |
| 3,774,333 | 11/1973 | Reynolds | 42/70.11 |
| 5,138,786 | 8/1992 | Fischer | 42/70.11 |
| 5,271,174 | 12/1993 | Bentley | 42/70.11 |
| 5,548,915 | 8/1996 | Szarmach et al. | 42/70.11 |

FOREIGN PATENT DOCUMENTS

| | | | |
|---|---|---|---|
| 70800 | 3/1950 | Denmark | 42/70.07 |

OTHER PUBLICATIONS

Universal Gunlock Industries, Gunloc Security Device, Feb. 1995, p. 18 of American Rifleman Jan./Feb. 1995.

*Primary Examiner*—Stephen M. Johnson

[57] ABSTRACT

A gun locking mechanism for use with a gun having a hollow handle portion and a barrel portion coupled at a first end thereof to a top end of the handle portion. The gun further has a sliding assembly slidably coupled to the barrel portion having first biased orientation for allowing access to the interior of the barrel and a magazine well and a second unbiased orientation for precluding access to the interior of the barrel and the magazine well. Also included is a gun locking mechanism with a pair of side faces each having a lower edge, an upper edge, a rear edge, and a front edge. Each side face has an upper lip extending perpendicularly from an upper edge thereof. One of the upper lips is larger than the other upper lip. The upper lips of each of the side faces are pivotally coupled. The gun locking mechanism further has a loading prevention mechanism including a horizontally orientated post coupled below the upper lips and a vertically orientated post also coupled below the upper lips.

5 Claims, 3 Drawing Sheets

GUN LOCKING MECHANISM

BACKGROUND OF THE INVENTION

1. Field of the Invention

The present invention relates to a gun locking mechanism and more particularly pertains to both precluding access to a trigger of a gun and further preventing the loading thereof.

2. Description of the Prior Art

The use of gun locking mechanisms is known in the prior art. More specifically, gun locking mechanisms heretofore devised and utilized for the purpose of preventing the inadvertent firing of a weapon are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,619,062 to Johnson; U.S. Pat. No. 4,709,496 to Johnson; U.S. Pat. No. 5,419,069 to Mumbleau et al.; U.S. Pat. No. 5,361,526 to Campbell; U.S. Pat. No. 5,437,119 Womack; and U.S. Pat. No. 4,384,420 to Von Muller.

In this respect, the gun locking mechanism according to the present invention substantially departs from the conventional concepts and designs of the prior art, and in so doing provides an apparatus primarily developed for the purpose of both precluding access to a trigger of a gun and further preventing the loading thereof.

Therefore, it can be appreciated that there exists a continuing need for a new and improved gun locking mechanism which can be used for both precluding access to a trigger of a gun and further preventing the loading thereof. In this regard, the present invention substantially fulfills this need.

SUMMARY OF THE INVENTION

In view of the foregoing disadvantages inherent in the known types of gun locking mechanisms now present in the prior art, the present invention provides an improved gun locking mechanism. As such, the general purpose of the present invention, which will be described subsequently in greater detail, is to provide a new and improved gun locking mechanism which has all the advantages of the prior art and none of the disadvantages.

To attain this, the present invention essentially comprises a gun. As shown in FIG. 1, the gun includes a hollow handle portion and a barrel portion coupled at a first end thereof to a top end of the handle portion. A trigger guard is coupled between the handle portion and the barrel portion. A trigger is pivotally coupled within the trigger guard. The gun further has a sliding assembly slidably coupled to the barrel portion having first biased orientation for allowing access to the interior of the barrel and a magazine well. For precluding access to the interior of the barrel and a magazine well, the sliding assembly of the gun further has a second unbiased orientation. Further provided is a gun locking mechanism. As shown in the Figures, the gun locking mechanism includes a pair of side faces each with a lower edge, an upper edge, a rear edge, and a front edge. Each side face has an upper lip extending perpendicularly from an upper edge thereof. One of the upper lips is larger than the other upper lip for reasons that will become apparent later. The upper lips of each of the side faces are pivotally coupled. See FIGS. 3 and 4. Each side face further has a front lip extending perpendicularly from a front edge thereof. For locking purposes, a first side face has a locking pin mechanism positioned adjacent the front lip thereof. As shown in. FIG. 4, the locking pin mechanism includes a rod rotatably coupled to the first side face. A tip is perpendicularly coupled to the rod opposite the first side face. A key mechanism is adapted to allow rotation of the rod between a first orientation with the tip directed downwardly and a second orientation with the tip directed to the side. It is imperative that such rotation is only allowed upon the insertion of a key within an associated key hole. Associated with the locking pin mechanism is a second side face having a locking pin receiving unit coupled thereto adjacent the front lip thereof. The locking pin receiving unit is adapted to receive the tip of the locking pin mechanism and further preclude the removal thereof in a locked mode. In such mode, the tip is received within the locking pin receiving unit and is and further directed to the side. With reference to FIG. 6, the gun locking mechanism further has a loading prevention mechanism. The loading prevention mechanism includes a mounting block coupled to the larger of the upper lips and depending downwardly. A first horizontally orientated post is coupled at an end thereof to the mounting block and extending forwardly. Further included is a second vertically oriented post coupled at an end thereof to the mounting block and extending downwardly therefrom.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gun locking mechanism which has all the advantages of the prior art gun locking mechanism and none of the disadvantages.

It is another object of the present invention to provide a new and improved gun locking mechanism which may be easily and efficiently manufactured and marketed.

It is a further object of the present invention to provide a new and improved gun locking mechanism which is of a durable and reliable construction.

An even further object of the present invention is to provide a new and improved gun locking mechanism which is susceptible of a low cost of manufacture with regard to both materials and labor, and which accordingly is then susceptible of low prices of sale to the consuming public, thereby making such gun locking mechanism economically available to the buying public.

Still yet another object of the present invention is to provide a new and improved gun locking mechanism which provides in the apparatuses and methods of the prior art some of the advantages thereof, while simultaneously overcoming some of the disadvantages normally associated therewith.

Still another object of the present invention is to both preclude access to a trigger of a gun and further prevent the loading thereof.

Lastly, it is an object of the present invention to provide a new and improved gun locking mechanism for use with a gun having a hollow handle portion and a barrel portion coupled at a first end thereof to a top end of the handle portion. The gun further has a sliding assembly slidably coupled to the barrel portion having first biased orientation for allowing access to the interior of the barrel and a magazine well and a second unbiased orientation for precluding access to the interior of the barrel and the magazine well. Also included is a gun locking mechanism with a pair of side faces each having a lower edge, an upper edge, a rear edge, and a front edge. Each side face has an upper lip extending perpendicularly from an upper edge thereof. One of the upper lips is larger than the other upper lip. The upper lips of each of the side faces are pivotally coupled. The gun locking mechanism further has a loading prevention mechanism including a horizontally orientated post coupled below the upper lips and a vertically orientated post also coupled below the upper lips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
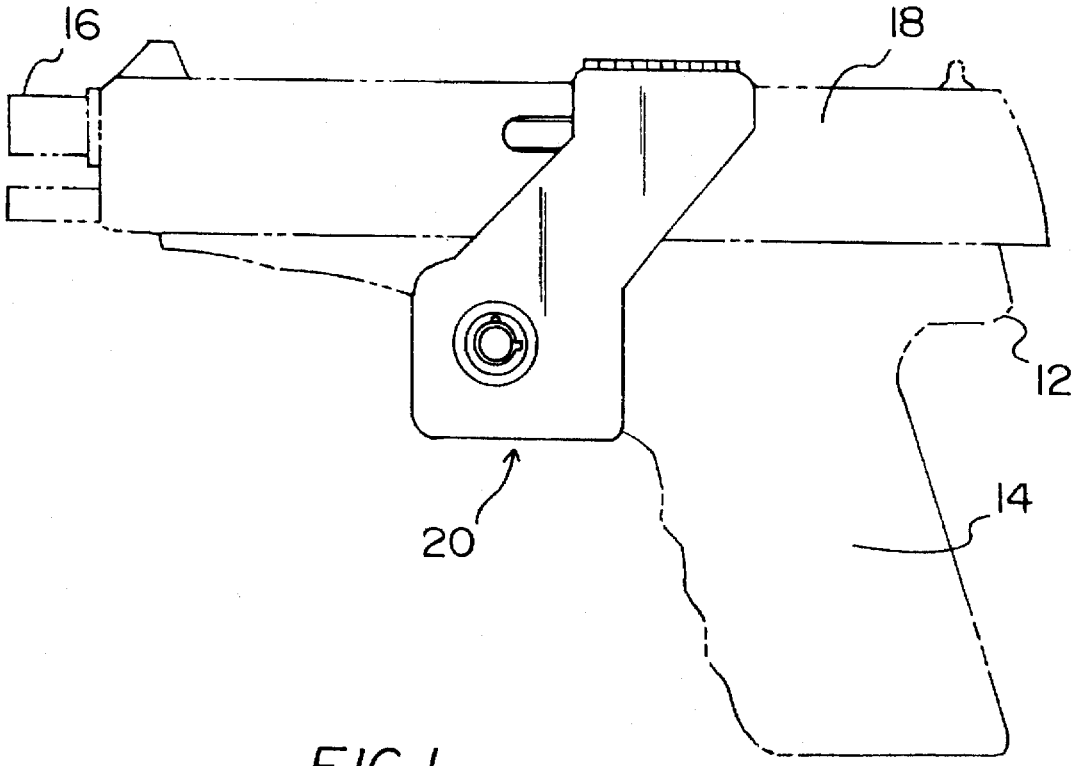
FIG. 1 is a perspective illustration of the preferred embodiment of the gun locking mechanism constructed in accordance with the principles of the present invention.

With reference now to the drawings, and in particular to FIG. 1 thereof, a new and improved gun locking mechanism embodying the principles and concepts of the present invention and generally designated by the reference numeral 10 will be described.

The present invention, the new and improved gun locking mechanism, is comprised of a plurality of components. Such components in their broadest context include a gun and gun locking mechanism. Such components are individually configured and correlated with respect to each other so as to attain the desired objective.

More specifically, it will be noted that the system 10 of the present invention includes a gun 12. As shown in FIG. 1, the gun includes a hollow handle portion 14 and a barrel portion 16 coupled at a first end thereof to a top end of the handle portion. An unillustrated trigger guard is coupled between the handle portion and the barrel portion. A trigger, also unillustrated, is pivotally coupled within the trigger guard. The gun further has a sliding assembly 18 slidably coupled to the barrel portion having first biased orientation for allowing access to the interior of the barrel and a magazine well. For precluding access to the interior of the barrel and a magazine well and further allowing the firing of the weapon, the sliding assembly of the gun further has a second unbiased orientation.

Figure 3:
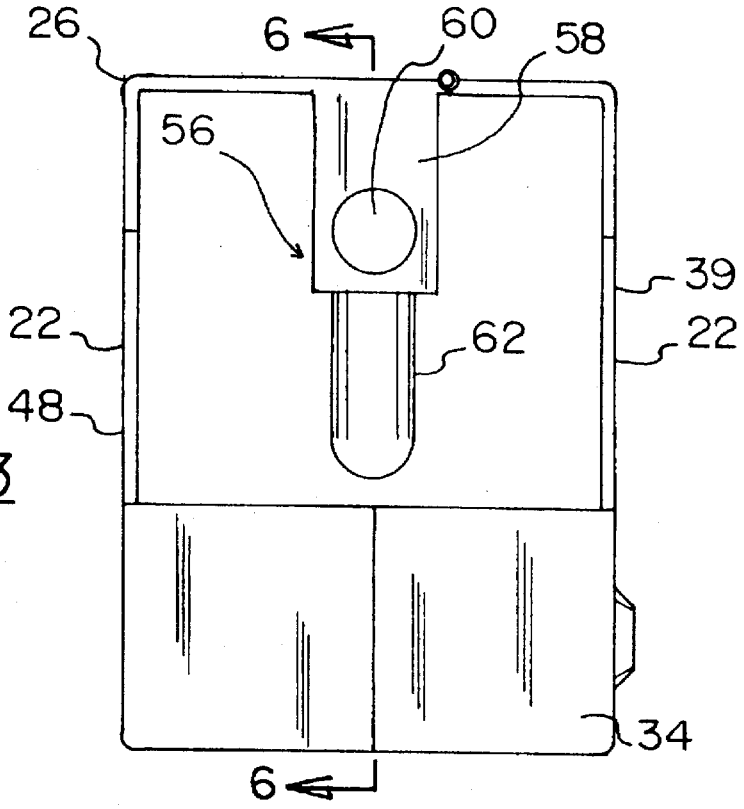
FIG. 3 is a front view of the present invention.

Further provided is a gun locking mechanism 20. As shown in the Figures, the gun locking mechanism includes a pair of side faces 22 each with a lower edge 24, an upper edge 26, a rear edge 28, and a front edge 30. Each side face has an upper lip 32 extending perpendicularly from an upper edge thereof. One of the upper lips is larger than the other upper lip for reasons that will become apparent later. The upper lips of each of the side faces are pivotally coupled. See FIGS. 3 and 4. Each side face further has a front lip 34 extending perpendicularly from a front edge thereof.

Figure 2:
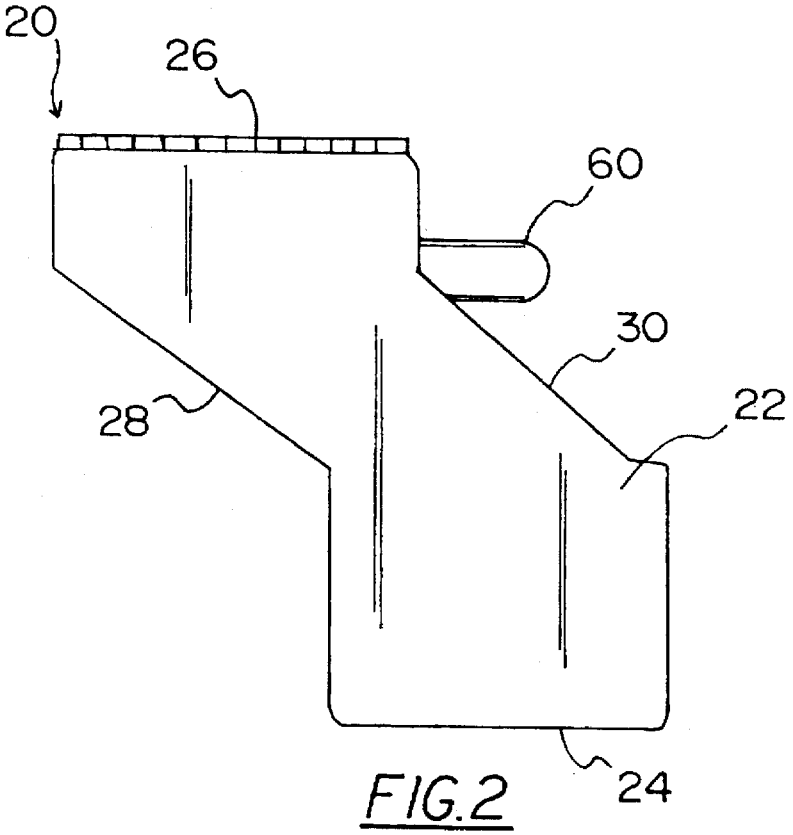
FIG. 2 is a side view of the present invention.

As shown in FIG. 2, a housing defined by the side faces, upper lips, and front lips has a rectangular configuration without a pair of opposite diagonal corners. As such, the upper lips reside only in a rear portion of the housing. In addition, the front lip resides only in a lower portion of the housing.

Figure 4:
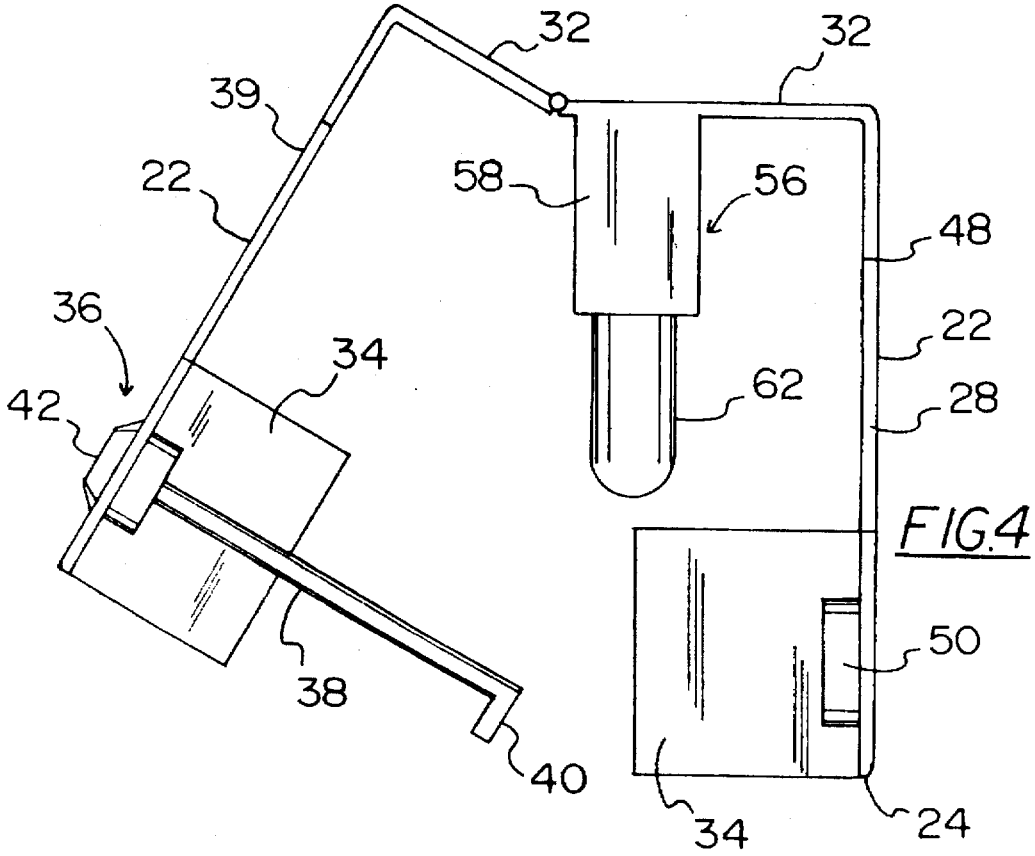
FIG. 4 is a rear view of the present invention with the side faces residing distant from each other.
Figure 5:
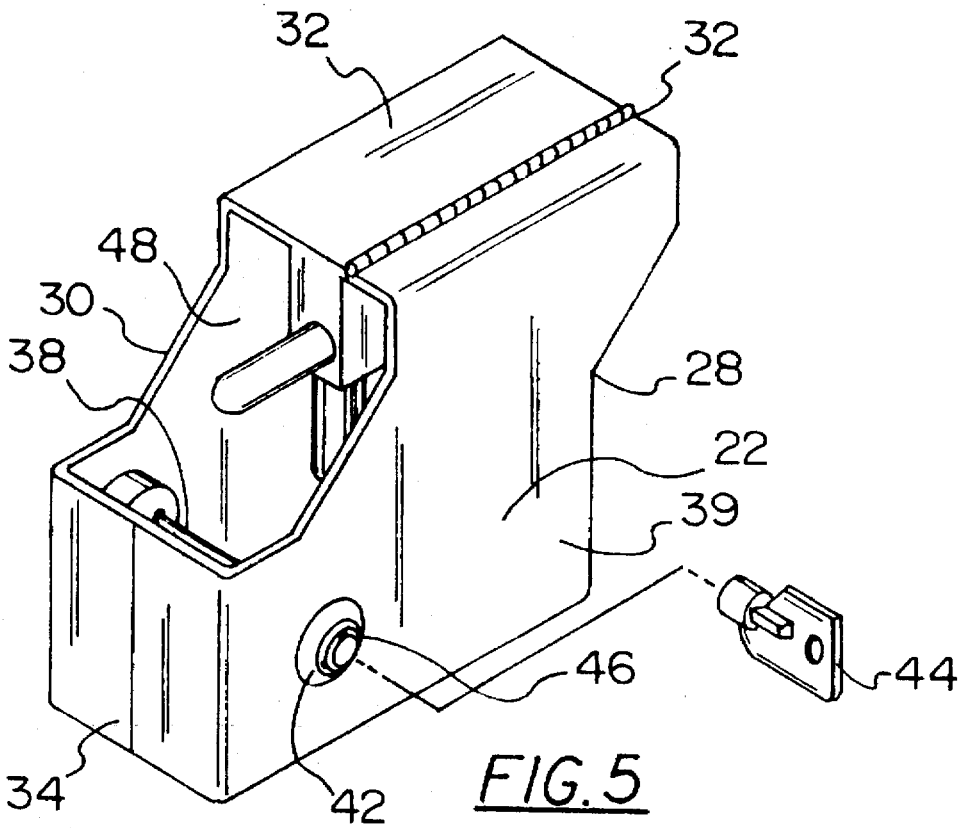
FIG. 5 is a perspective view of the present invention.

For locking purposes, a first side face has a locking pin mechanism 36 positioned adjacent the front lip thereof. As shown in FIG. 4, the locking pin mechanism includes a rod 38 rotatably coupled to the first side face 39, A tip 40 is perpendicularly coupled to the rod opposite the first side face. A key mechanism 42 is adapted to allow rotation of the rod between a first orientation with the tip directed downwardly and a second orientation with the tip directed to the side. It is imperative that such rotation is only allowed upon the insertion of a key 44 within an associated key hole 46. The key preferably comprises a chuck key. Associated with the locking pin mechanism is a second side face 48 having a locking pin receiving unit 50 coupled thereto adjacent the front lip thereof. The locking pin receiving unit is adapted to receive the tip of the locking pin mechanism and further preclude the removal thereof in a locked mode. In such mode, the tip is received within the, locking pin receiving unit and is further directed to the side. To accomplish its purpose, the locking pin receiving unit includes a circular compartment with a vertically oriented rectangular cut out formed therein. See FIG. 6.

Figure 6:
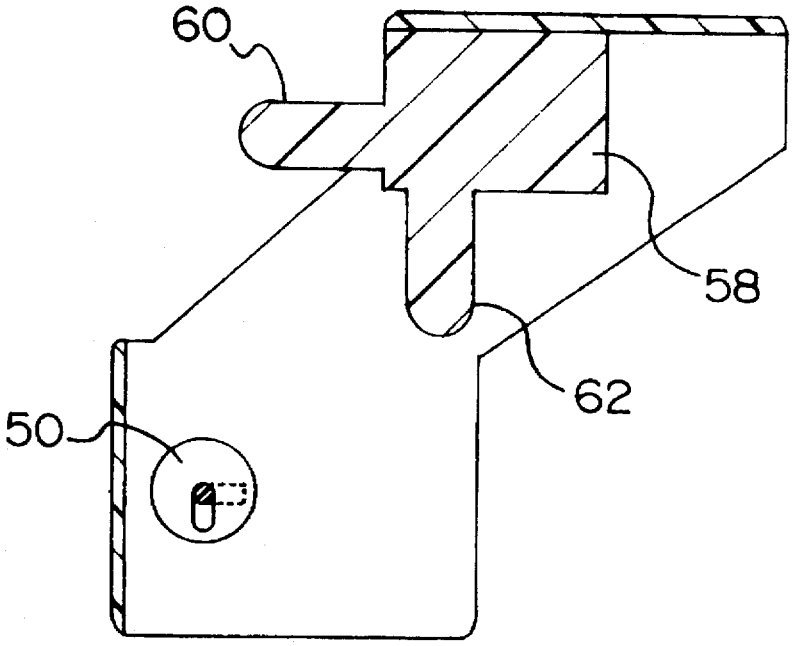
FIG. 6 is a cross-sectional view of the present invention taken along line 6—6 shown in FIG. 3.

With further reference to FIG. 6, the gun locking mechanism also has a loading prevention mechanism 56. The loading prevention mechanism includes a mounting block 58 coupled to the larger of the upper lips and depending downwardly. As shown in FIG. 4, the mounting block is coupled to an upper lip opposite the upper lip associated with the side face which has the locking pin mechanism coupled thereto. A first horizontally orientated post 60 is coupled at an end thereof to the mounting block and extending forwardly. Further included is a second vertically oriented post 62 coupled at an end thereof to the mounting block and extending downwardly therefrom.

In use upon the sliding assembly of the gun being in the first orientation thereof, the side faces of the gun locking mechanism may be positioned abuttingly on opposite sides of the gun wherein the front lips abut each other about the trigger guard of the gun. As such, access to the trigger is prevented. In addition, the horizontally oriented post of the loading prevention mechanism is situated within the barrel of the gun and the vertically orientated post of the loading prevention mechanism is situated within the magazine well of the gun. It should be noted that the vertically oriented post precludes a magazine from being inserted within the handle of the gun. To ensure that the foregoing safety features are maintained, the side faces may be kept in abutment with the gun via the locking pin mechanism and locking pin receiving unit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved gun locking mechanism comprising, in combination:

a gun with a hollow handle portion, a barrel portion coupled at a first end thereof to a top end of the handle portion, a trigger guard coupled between the handle portion and the barrel portion, and a trigger pivotally coupled within the trigger guard, the gun further having a sliding assembly slidably coupled to the barrel portion having first biased orientation for allowing access to the interior of the barrel and a magazine well and a second unbiased orientation for precluding access to the interior of the barrel and said magazine well; and a gun locking mechanism including a pair of side faces each with a lower edge, an upper edge, a rear edge, and a front edge, each side face having an upper lip extending perpendicularly from said upper edge thereof with one of the upper lips being larger than the other upper lip, wherein the upper lips of each of the side faces are pivotally coupled, each side face further having a front lip extending perpendicularly from said front edge thereof, the side faces including a first side face having a locking pin mechanism positioned adjacent the front lip thereof, the locking pin mechanism including a rod rotatably coupled to the first side face, a tip perpendicularly coupled to the rod opposite the first side face, a key mechanism adapted to allow rotation of the rod between a first orientation with the tip directed downwardly and a second orientation with the tip directed to the side only upon the insertion of a key within an associated key hole, the side faces including a second side face having a locking pin receiving unit coupled thereto adjacent the front lip thereof, the locking pin receiving unit adapted to receive the tip of the locking pin mechanism and further preclude the removal thereof in a locked mode wherein the tip is received therein and further directed to the side, the gun locking mechanism further having a loading prevention mechanism including a mounting block coupled to the larger of the upper lips and depending downwardly, a first horizontally orientated post coupled at an end thereof to the mounting block and extending forwardly, a second vertically oriented post coupled at an end thereof to the mounting block and extending downwardly therefrom;

whereby upon the sliding assembly of the gun being in the first orientation thereof, the side faces of the gun locking mechanism may be positioned abuttingly on opposite sides of the gun wherein the front lips abut each other about the trigger guard of the gun thus precluding access to the trigger, the horizontally oriented post of the loading prevention mechanism is situated within the barrel of the gun, the vertically orientated post of the loading prevention mechanism is situated within the magazine well of the gun, and the side faces may be maintained in abutment with the gun via the locking pin mechanism and locking pin receiving unit.

2. A gun locking mechanism comprising:

a gun with a hollow handle portion, a barrel portion coupled at a first end thereof to a top end of the handle portion, a trigger guard coupled between the handle portion and the barrel portion, and a trigger pivotally coupled within the trigger guard, the gun further having a sliding assembly slidably coupled to the barrel portion having first biased orientation for allowing access to the interior of the barrel and a magazine well and a second unbiased orientation for precluding access to the interior of the barrel and said magazine well; and a gun locking mechanism including a pair of side faces each with a lower edge, an upper edge, a rear edge, and a front edge, each side face having an upper lip extending perpendicularly from said upper edge thereof with one of the upper lips being larger than the other upper lip, wherein the upper lips of each of the side faces are pivotally coupled, the gun locking mechanism further having a loading prevention mechanism including a horizontally orientated post coupled below one of the upper lips;

whereby upon the sliding assembly of the gun being in the first orientation thereof, the side faces of the gun locking mechanism may be positioned abuttingly on opposite sides of the gun thus precluding access to the trigger, the horizontally oriented post of the loading prevention mechanism is situated within the barrel of the gun, and the side faces may be maintained in abutment via a locking means.

3. A gun locking mechanism as set forth in claim 2 wherein each side face further has a front lip extending perpendicularly from said front edge thereof.

4. A gun locking mechanism as set forth in claim 2 wherein the locking means includes a locking pin mechanism positioned on a first side face of the side faces, the locking pin mechanism including a rod rotatably coupled to the first side face, a tip perpendicularly coupled to the rod opposite the first side face, a key mechanism adapted to allow rotation of the rod between a first orientation with the tip directed downwardly and a second orientation with the tip directed to the side only upon the insertion of a key within an associated key hole, the side faces further including a second side face having a locking pin receiving unit coupled thereto, the locking pin receiving unit adapted to receive the tip of the locking pin mechanism and further preclude the removal thereof in a locked mode wherein the tip is received therein and further directed to the side.

5. A gun locking mechanism comprising:

a gun with a hollow handle portion, a barrel portion coupled at a first end thereof to a top end of the handle portion, a trigger guard coupled between the handle portion and the barrel portion, and a trigger pivotally coupled within the trigger guard, the gun further having a sliding assembly slidably coupled to the barrel portion having first biased orientation for allowing access to the interior of the barrel and a magazine well and a second unbiased orientation for precluding access to the interior of the barrel and said magazine well; and a gun locking mechanism including a pair of side faces each with a lower edge, an upper edge, a rear edge, and a front edge, each side face having an upper lip extending perpendicularly from said upper edge thereof with one of the upper lips being larger than the other upper lip, wherein the upper lips of each of the side faces are pivotally coupled, the gun locking mechanism further having a loading prevention mechanism including a vertically orientated post coupled below one of the upper lips;

whereby upon the sliding assembly of the gun being in the first orientation thereof, the side faces of the gun locking mechanism may be positioned abuttingly on opposite sides of the gun thus precluding access to the trigger, the vertically oriented post of the loading prevention mechanism is situated within the magazine wheel of the gun, and the side faces may be maintained in abutment via locking means.

* * * * *